United States Patent [19]

Palmaer

[11] 4,010,340

[45] Mar. 1, 1977

[54] SWITCH MEMBER FOR PORTABLE, BATTERY-OPERATED APPARATUS

[76] Inventor: Tore Georg Palmaer, Smultronvagen 28, S-331 00 Varnamo, Sweden

[22] Filed: May 5, 1975

[21] Appl. No.: 574,700

[52] U.S. Cl. ..... 200/330; 200/DIG. 2; 200/61.19; 200/153 M

[51] Int. Cl.[2] ..... H01H 3/20

[58] Field of Search ..... 200/153 T, 329, 330, 200/331, DIG. 2, 61.19, 61.41, 61.58 R, 52 R, 153 M, 335, 336; 340/279

[56] References Cited

UNITED STATES PATENTS

| | | | |
|---|---|---|---|
| 1,211,976 | 1/1917 | Spencer | 200/DIG. 2 |
| 3,227,836 | 1/1966 | Renwick, Sr. | 200/61.58 R |
| 3,303,708 | 2/1967 | Rhodes | 200/153 T |
| 3,484,572 | 12/1969 | Froyd | 200/153 T |
| 3,586,798 | 6/1971 | Holmes | 200/DIG. 2 |

*Primary Examiner*—Gerald P. Tolin

[57] ABSTRACT

A switch member for portable, battery operated apparatus, such as staff location systems, which is provided with hearing sets worn on the head, ear-phones, speech amplifiers, radio receivers and the like including at least one attachement or suspension member. The switch member is arranged to be automatically moved to and forcibly retained in a circuit-closing contact position under pressure from the attachment or suspension member of the apparatus.

4 Claims, 3 Drawing Figures

SWITCH MEMBER FOR PORTABLE, BATTERY-OPERATED APPARATUS

BACKGROUND OF THE INVENTION

The present invention relates to a switch member for portable, battery operated apparatus, such as staff location systems, hearing sets worn on the head, earphones, speech amplifiers, radio receivers and the like, said apparatus including at least one attachment or suspension member.

Such portable, battery-operated apparatus should be small and light which also means that small batteries in relation to driving current and operating time must be used.

When such apparatus are used more or less continuously during some part of the working hours, one often forgets to turn off the apparatus when it is not being used, which results in unnecessary current consumption which considerably effects the life of the battery.

The object of the present invention is therefore to eliminate these drawbacks and to effect automatic switching on of such apparatus during use and automatic switching off when the apparatus is not being used.

This object, others and numerous advantages will be set forth and apparent from the following description of the invention.

SUMMARY OF THE INVENTION

According to the invention a sprung or spring-biased switch member is arranged to be automatically moved to and forcibly retained in a circuit-closing contact position under pressure from the attachment or suspension member of the apparatus.

In the case of a staff locator, for example, the attachment member and the spring-biased switch member may suitably form a pivotably journalled arm made in one piece, i.e. a so-called clip attachment. When using the invention for apparatus worn on the head, for example, having a yielding head yoke, the suspension member may suitably consist of the head yoke and this may suitably be joined to an axially movable pin arranged to cooperate with the switch member.

BRIEF DESCRIPTION OF THE DRAWING

Full details of the present invention follows herein and will be seen in connection with the accompanying drawings, where.

DESCRIPTION OF THE INVENTION

Figure 1:
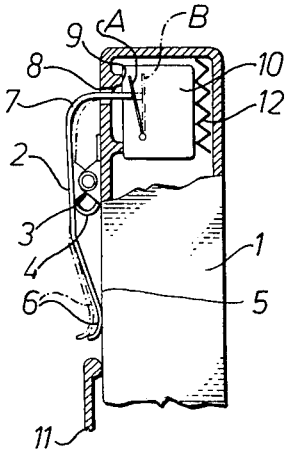
FIG. 1 shows a staff locator including a switch in accordance with the invention.

The staff locator 1 shown in FIG. 1 is intended to be fitted in a jacket pocket or the like by means of a clip-like member 2. The member 2 is pivotably journalled about a shaft 3 against the action of a spring 4. The shaft 3 is in this case suitably attached on the outside of the casing 5 of the staff locator 1. One end 6 of the member 2 is conventionally bent in towards the casing 5 and rests against the outside of the housing 5 when not in use. The opposite end 7 of the member 3 has an extension which passes through an opening 8 in the casing 5 and the end 9 of the extension is arranged to cooperate with a microswitch 10 spring-journalled in the housing.

When the staff locator 1 is attached by the member 3 onto a pocket or the like, therefore, the material 11 will be located between the end 6 of the member 3 and the outer side of the casing 5, so that the end section 9 of the member 3 will press the pressure switch to the position indicated by a broken line B, thus connecting the current. When the staff locator 1 is removed from the pocket, and end 6 of the member 3 will return to its position in contact with the outer wall of the housing and the current is automatically disconnected (position A).

To enable it to take up large movements if the end section 6 of the member 3 is clamped over a relatively thick material, the switch 10 is suitably embedded in a yielding material 12.

Of course the means can also be used for manual operation - i.e without being attached in a pocket or the like, in which case the upper end 7 of the clip member 2 should be kept pressed in each time the apparatus is in use.

Figure 2:
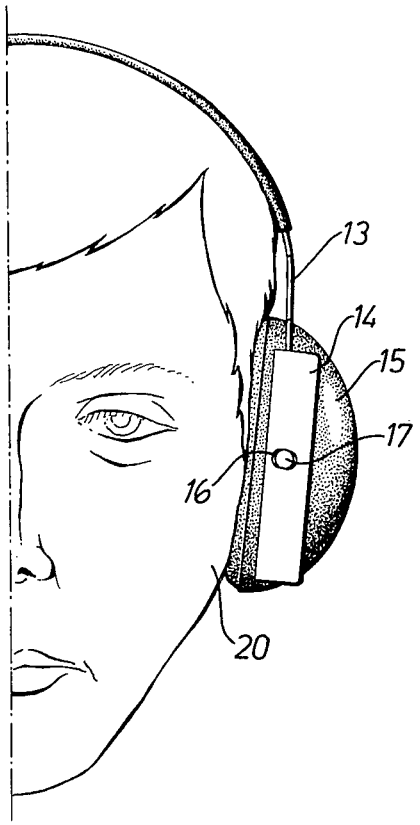
FIG. 2 and 3 show a switch in accordance with the invention for automatically switching off a receiver attached to a head yoke.
Figure 3:
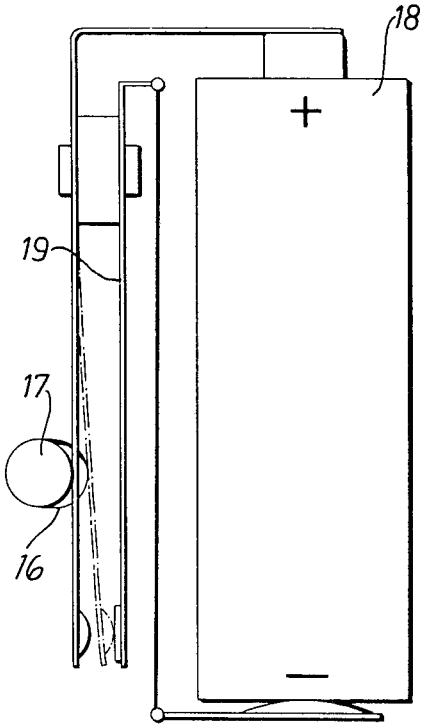

In the embodiment shown in FIG. 2 and 3 a means constructed in accordance with the invention has been arranged on a head yoke 13. On said head yoke 13 a loop receiver 14 is arranged in which an ear-muff cover 15 houses an earphone journalled on a pin 17 extending through a slot 16 in the loop receiver 14. The receiver is operated by a battery 18 which is connected by means of a double armed spring-journalled switch 19. When the ear-muff cover 15 lies against the cheek 20, the yoke 13 presses the loop receiver 14 against the outer side of the pin 17 displacing one arm of the switch 19 and connects the current. When the ear-muff is removed from the head the contact pressure ceases between the loop receiver 14 and the pin 17 and the current is automatically disconnected.

Thus it is apparent that while the present invention has been shown in only one embodiment, numerous changes and modifications can still be made. The present disclose should, therefore, be taken as illustrative only and not limiting the invention.

What is claimed is:

1. An automatic switch for portable battery operated radio receivers and the like comprising a housing in which said receiver or the like is located, an attachment member affixed to said housing for supporting said housing in use, a movable contact and a fixed contact located within said housing in a circuit between the receiver and the battery, said movable contact being spring biased in normally open position with respect to said fixed contact, said attachment member for supporting said housing being movable with respect to said housing into engagement with said movable contact to displace the same from its biased position into contact with said fixed contact.

2. The switch according to claim 1 including spring means for normally biasing said attachment member out of engagement with said movable contact.

3. The switch according to claim 1, where said attachment member and the movable switch contact form a pivotal arm journalled in said housing which arm is made in one piece.

4. The switch according to claim 1, where the suspension member consists of the head yoke joined to an axially movable pin located in said housing and arranged to cooperate with the movable switch contact.

* * * * *